US010076854B2

(12) United States Patent
Hamouda et al.

(10) Patent No.: US 10,076,854 B2
(45) Date of Patent: Sep. 18, 2018

(54) AGGREGATE COOLING FOR HOT WEATHER CONCRETING

(71) Applicant: QATAR UNIVERSITY, Doha (QA)

(72) Inventors: Abdel Magid Hamouda, Doha (QA); Khaled Ibrahim ElSayed Ahmed, Doha (QA); Seyed Sajad Mirjavadi, Doha (QA); Mohamed Gadala, Vancouver (CA)

(73) Assignee: QATAR UNIVERSITY, Doha (QA)

( * ) Notice: Subject to any disclaimer, the term of this patent is extended or adjusted under 35 U.S.C. 154(b) by 0 days.

(21) Appl. No.: 15/080,049

(22) Filed: Mar. 24, 2016

(65) Prior Publication Data

US 2016/0279826 A1 Sep. 29, 2016

Related U.S. Application Data

(60) Provisional application No. 62/137,722, filed on Mar. 24, 2015.

(51) Int. Cl.
*F26B 11/02* (2006.01)
*B28C 7/00* (2006.01)

(52) U.S. Cl.
CPC ..... *B28C 7/0038* (2013.01)

(58) Field of Classification Search
CPC ..... F26B 11/00; F26B 11/02; B28C 7/0038; F27B 7/24
USPC ..... 34/428; 366/7
See application file for complete search history.

(56) References Cited

U.S. PATENT DOCUMENTS 856,770 A * 6/1907 Cummer ..... F26B 11/028 34/134
1,196,376 A * 8/1916 Meyer ..... B01F 9/06 34/135
1,867,739 A * 7/1932 Walter ..... E01C 19/1009 366/18
1,995,966 A * 3/1935 Cyrille ..... B01D 11/0276 134/153
2,042,979 A * 6/1936 Anderson ..... F26B 11/045 165/120

(Continued)

FOREIGN PATENT DOCUMENTS

CN 1586854 A 3/2005
CN 202742514 2/2013

(Continued)

OTHER PUBLICATIONS

"Nomad: Hot Mix Asphalt Plant", CEI Enterprises; Alberquerque, NM; 2008 (5 pages).

(Continued)

*Primary Examiner* — Stephen M Gravini
(74) *Attorney, Agent, or Firm* — Squire Patton Boggs (US) LLP

(57) ABSTRACT

Systems and methods for cooling aggregate are described. Systems and methods may include a drum. The drum may include an aggregate inlet; a plurality of buckets arranged in a ring around a circumference of the drum, and a plurality of rings arranged along the length of the drum, wherein each of the plurality of buckets has openings that open into the interior of the drum; one or more radial donuts or radial webs within the interior of the drum; an aggregate outlet; and a cooling air supply.

15 Claims, 7 Drawing Sheets

(56) References Cited

U.S. PATENT DOCUMENTS 2,305,078 A * 12/1942 Harford ..... C05G 3/0058 34/137
2,552,835 A * 5/1951 Arnold ..... F26B 11/0413 34/128
3,360,868 A * 1/1968 Arnold ..... F26B 3/00 34/395
3,469,324 A * 9/1969 Vissers ..... B22C 5/04 34/136
4,177,575 A * 12/1979 Brooks ..... F26B 11/028 34/129
4,427,376 A * 1/1984 Etnyre ..... E01C 7/267 366/25
4,955,722 A * 9/1990 Marconnet ..... E01C 19/1004 366/25
5,095,968 A 3/1992 Didion
5,220,732 A 6/1993 Lee
5,480,226 A 1/1996 Milstead
5,664,881 A 9/1997 Hawkins et al.
5,860,221 A * 1/1999 Morrison ..... B65D 88/28 34/167
5,950,325 A * 9/1999 Mehdizadeh ..... F26B 3/343 219/701
6,036,352 A 3/2000 Sakamoto
6,185,842 B1 * 2/2001 Brashears ..... E01C 19/1063 34/137
6,209,225 B1 * 4/2001 Villarroel ..... F26B 11/045 34/599
6,340,240 B1 * 1/2002 Swisher, Jr. ..... E01C 19/1036 34/137
7,155,841 B2 * 1/2007 Livingston ..... F26B 11/0413 34/136
7,204,636 B2 4/2007 Didion
7,343,697 B2 * 3/2008 Dillman ..... F26B 11/0477 34/137
7,574,816 B2 * 8/2009 Shivvers ..... F26B 3/205 34/333
8,336,714 B2 * 12/2012 Campbell ..... B07B 1/15 209/11
8,356,420 B2 * 1/2013 Morrison ..... F26B 17/124 209/134
8,567,086 B2 * 10/2013 Kanai ..... F26B 17/24 34/102
9,085,739 B2 * 7/2015 Nakagawa ..... C10B 49/04
9,239,187 B2 * 1/2016 Pepitone ..... F26B 3/24
9,566,557 B2 * 2/2017 Huh ..... B01F 9/001
2005/0236320 A1 10/2005 Didion
2008/0209759 A1 * 9/2008 Shivvers ..... F26B 11/04 34/514
2013/0081298 A1 * 4/2013 Bugg ..... F26B 5/00 34/389
2016/0279826 A1 * 9/2016 Hamouda ..... B28C 7/0038

FOREIGN PATENT DOCUMENTS

CN 203349625 U 12/2013
JP 03-108510 A 5/1991
JP 06-304919 A 11/1994
JP 10-329130 A 12/1998
WO 2012/081975 A1 6/2012
WO 2014/055099 A1 4/2014

OTHER PUBLICATIONS

"Double Barrel: The Astec Turbo Double Barrel Drum-Mixer is the most popular production product on the market", HOT-MIX Magazine, vol. 7, No. 3; 2002 (pp. 6-9).

K.I.E. Ahmed et al., "Cooling Concrete Aggregates: Challenges in Design and Simulation"; 6th IASME/WSEAS International Conference on Heat Transfer, Thermal Engineering and Environment (HTE'08); Rhodes, Greece, Aug. 20-22, 2008 (pp. 396-401).

* cited by examiner

Fig. 5

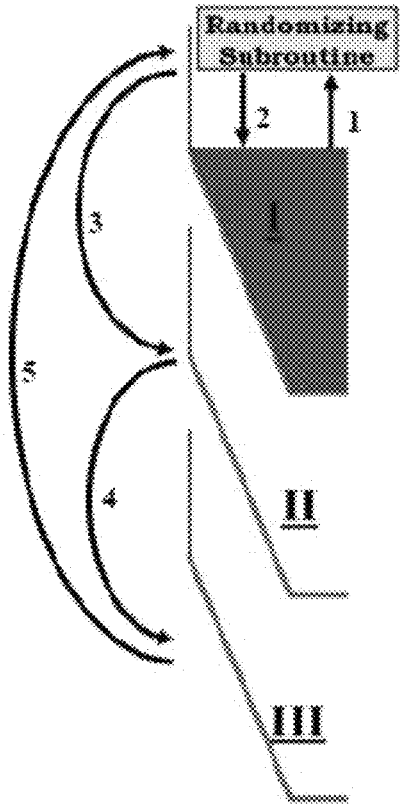

After Solution Step *i*

1- The aggregate nodal temperatures are transferred to the Randomizing Subroutine 2- The randomized aggregates nodal temperatures are assigned for initial conditions of step *i+1*

3- The drum body nodal temperature of bucket I is assigned as initial conditions of step *i+1* for bucket II nodes 4- The drum body nodal temperature of bucket II is assigned as initial conditions of step *i+1* for bucket III nodes.

5- The drum body nodal temperature of bucket III is assigned as initial conditions of step *i+1* for bucket I nodes

AGGREGATE COOLING FOR HOT WEATHER CONCRETING

CROSS REFERENCE TO RELATED APPLICATIONS

This application is related to and claims the benefit and priority of U.S. Provisional Application No. 62/137,722 filed Mar. 24, 2015, the entirety of which is incorporated herein by reference.

FIELD OF THE INVENTION

The present invention relates to systems and methods for concreting, and, more specifically, to systems and methods for cooling aggregate or other materials.

BACKGROUND OF THE INVENTION

Ready-mixed concrete manufacturers, in hot weather regions are faced with drops in compressive strengths of concrete produced in summer, as shown in FIG. 1. High ambient temperatures increase the rate of evaporation from fresh concrete resulting in lower effective water content and hence lower effective water-cement ratio per weight. Reduction of compressive strength has also been observed on specimens produced under a controlled environment and tested in a laboratory. High temperature accelerates cement hydration and the bonding between the cement grains becomes weaker. Therefore, the early-age strength increases with higher curing temperatures because the reaction rate is faster, but 28-day strength decreases because of the poor bonding between cement grains at these elevated temperatures. It is noted that higher temperature aggregates results in greater concentration of calcium hydroxide at the interface. This observation leads to the assumption that the transition zone might be weakened by chemical phenomenon due to the rise of the constituent temperatures.

The weather conditions of many regions of the world are associated with hot weather for six to eight months per year. Northern and southern Africa, Arab peninsula, Southern Asia, Southern part of North America, Middle regions of Latin America, and northern Australia are the hottest regions in the world. The weather fluctuates between summer temperatures that approach 50° C. and winter temperatures that sink to 18° C. Relative humidity follows a similar pattern ranging between 5% and 90% from inland to coastal regions, respectively. Ready-mixed concrete manufacturers have to accommodate these extreme highs and lows in climate fluctuation.

Aggregate temperature plays a very important role in defining the concrete mix temperature. It has been shown that keeping the aggregate temperature about 10° C.-15° C. is adequate in achieving proper results. Cooling the concrete aggregate is one of the most effective methods to reduce the concrete mix temperature. Different methods have been developed for that purpose. In these methods cooling is obtained using; chilled-water, ice, chilled-air, or liquid Nitrogen. The key factor in choosing the proper method is the most economic technique without degrading the cement properties. The optimization analysis results will depend significantly on the amount of aggregates to be cooled down and the required temperature drop.

Cooling using liquid Nitrogen has many virtues, however, there has not been a great deal of testing. There is a lot more industry needs to know about how liquid nitrogen affects cement hydration products, concrete set, and concrete production equipment as well. Furthermore, there are safety issues that need to be addressed more fully. Chilled water is commonly used in reducing the aggregates temperature in hot weather. Cooling 600 $m^3$ of aggregates at 7° C. requires about 300 $m^3$ of chilled water storage which costs about $20,000. Ready mix concrete industries in hot regions, however, may require a temperature drop of about 35° C. for much bigger amount of aggregates. In such case although cooling by chilled water is an effective method it will be highly costly and not feasible to achieve such target. Furthermore, the concrete aggregates are required to be mostly dry before mixing to achieve lipophilic (oil-loving) surface for good bonding between the cement and the aggregate during mixing. Flake ice could be added to the mixing drum as a direct substitute for batched water on a pound-for-pound basis. It is reported that an ice making plant that delivers 10 tons of ice per day would cost about $300,000. Thus, medium production rate plants that require around 100 tons/hr of concrete will require a huge investment to accommodate for a proper ice maker plant. Chilled air is a preferred candidate, although this requires huge flow rates and extensive cooling systems. It is explicitly reported that chilled-air cooling is an economical option when large volumes of aggregates must be cooled with significant large temperature difference.

The above mentioned cooling methods are utilized through different cooling equipment. Among those are belt conveyors, cooling drums, chilled storage rooms, and a mix of those methods. Most of this equipment is meant for cooling and drying the foundry sand. It could be adopted, however, for sand and coarse aggregates cooling. The cooling drums are designed on the basis of well mixing the aggregates using radial webs. The cooling process in the existing drums in the market is based on mixing the aggregates to enlarge the contact area between the aggregates and the cooling air. Research shows that drying drums are very compact, efficient, and provide a high production rate. Cooling drums entail, the disadvantages of being quite expensive, consume high mechanical power, and are difficult to maintain. On the other hand, cooling using air jets over belt conveyors may be the cheapest and simplest method. However, the concrete industry reports long cooling time, low cooling efficiency, large occupied space and a low production rate. A combination of both methods is generally recommended. Three-stage cooling of return sand is effective and efficient when flash cooling and premixing are accomplished on a belt conveyor and final cooling is performed in a rotary sand blending, cooling, screening drum.

Convection to the cooling air is the main heat transfer theme in these previous designs. Cooling through the thermal contact between the aggregates and the cold belt conveyor or drum body as well as the mixing process was neither analyzed nor optimized. The heat flow during the cooling process, either by belt conveyors or drums, needs to be analyzed and optimized to achieve short and optimum cooling time with low cooling power. The main objectives of the current work are to propose optimized designs for belt conveyors system and drum cooling system to be used in cooling the concrete coarse and fine aggregates and to present a numerical simulation for the cooling process using the finite element method with the objective of optimizing the overall system performance.

Needs exist for improved systems and methods for cooling aggregates.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings:

FIG. 5 shows a schematic of initial conditions calculation mechanisms for drum buckets after one third of the drum revolution according to an exemplary embodiment.

DETAILED DESCRIPTION OF THE PREFERRED EMBODIMENTS

Systems and methods are described for using various tools and procedures for aggregate cooling. In certain embodiments, the tools and procedures may be used in conjunction with regulating temperature of materials. The examples described herein relate to aggregate cooling for illustrative purposes only. The systems and methods described herein may be used for many different industries and purposes, including concrete, drilling, and/or other industries completely. In particular, the systems and methods may be used for any industry or purpose where cooling of solid or other materials is needed.

Cooling System

Systems may include a drum for cooling aggregate. The drum may be made of sheets that form various buckets. The sheets may be steel, alloys or other similar materials. In certain embodiments, there may be twelve buckets, but other numbers and configurations may be possible. Each bucket may have a predetermined depth. In certain embodiments, the buckets may have a depth of approximately 1 m. In certain embodiments, the depths of the buckets may be the same or may vary. Each of the buckets may have an opening angle of approximately 45 degrees that may start at an end of a radial donut that has a predetermined width. Other opening angles may be used. The predetermined width may be approximately 0.6 m. In certain embodiments, the empty drum may have a repeated pattern.

Figure 1:
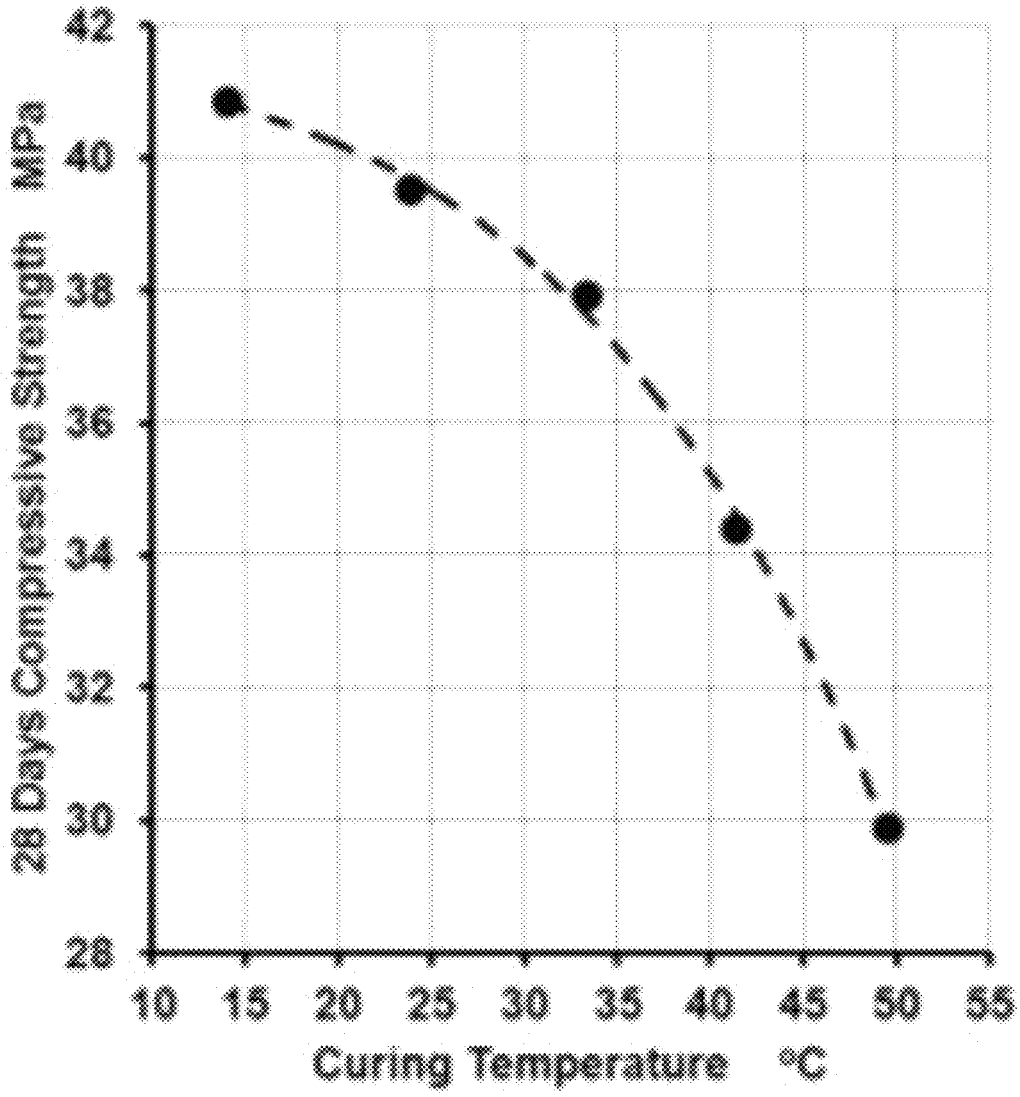
FIG. 1 shows an effect of aggregate temperature on 28-day concrete compressive strength.
Figures 2, 3:
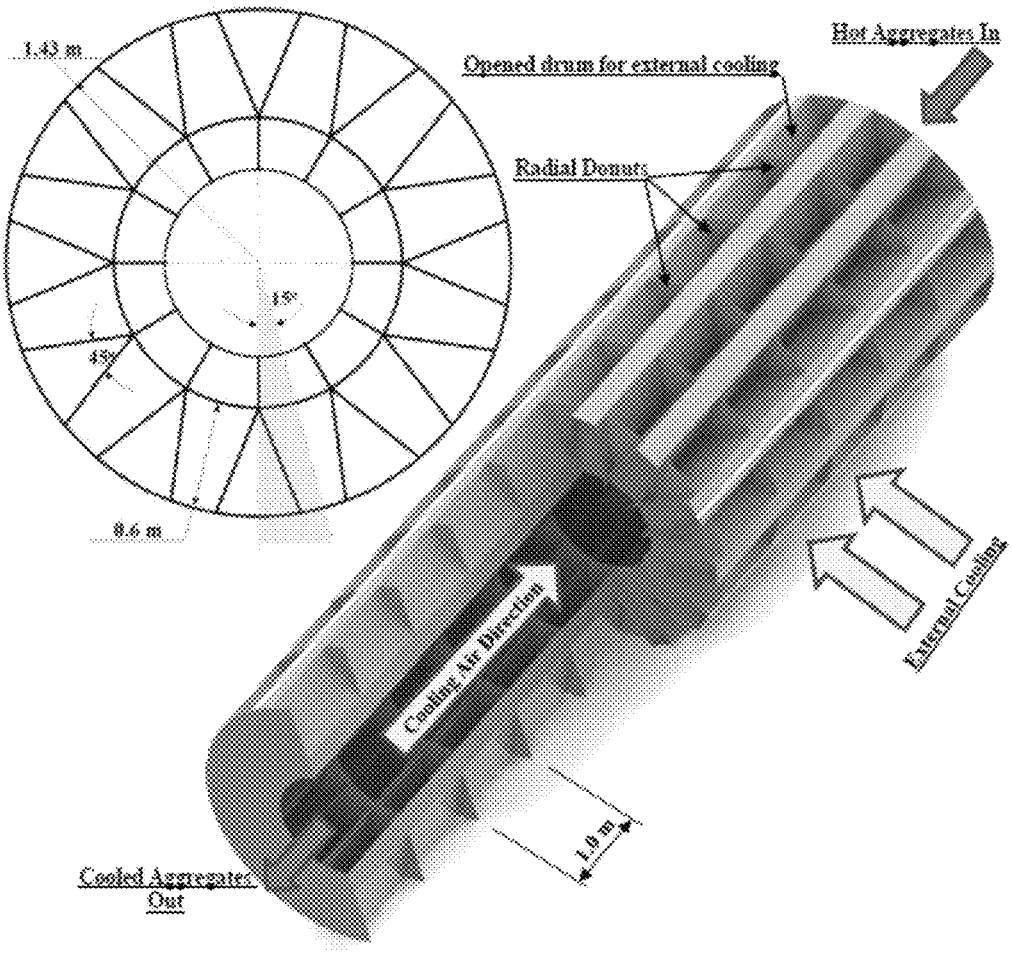
FIG. 2 shows a cross section view of a drum according to an exemplary embodiment.
FIG. 3 shows a perspective, partial cross section view of the drum of FIG. 2 according to an exemplary embodiment.

FIGS. 2 and 3 show a cross section of an exemplary cooling drum. Radial donuts (rings) and axial webs may be welded inside the drum in such a way to facilitate slow axial movement of the aggregate as the drum rotates. Radial donuts (rings) are steel rings of various thickness, such as for example, steel rings with thickness of 2-5 mm. In some alternatives, the dimension of the Radial donuts (rings) may depend on the drum size. In some alternatives, the external diameter of the Radial donuts (rings) may be the same as that of the drum, which ranges from approximately 3 to approximately 4.5 m. In some alternatives, the internal diameter of these Radial donuts (rings) may range from approximately 1 to approximately 1.5 m. In some alternatives, these Radial donuts (rings) may be evenly distributed throughout the drum length, for example, with a distance of approximately 1 to approximately 1.5 m between each pair of consecutive Radial donuts (rings). Axial webs are steel strips that may be the same thickness as the Radial donuts (rings). For example, these Axial webs may be 12, 16, or 20 Axial webs evenly distributed circumferentially along the whole drum length. Openings in the external body of the drum may enlarge the cold surface areas in-contact with aggregates and also enhance the cooling of the internal radial donuts.

In certain embodiments, a system for cooling aggregate may include a drum. The drum may include one or more aggregate inlets to allow access to the interior of the drum. The drum may include a plurality of buckets arranged around the circumference of the drum in a ring. There may be one or more rings of buckets along the length of the drum. In certain embodiments, each ring of buckets may include various numbers of buckets. In certain embodiments, each ring may include 12 buckets. Each of the plurality of buckets may have an opening that opens into the interior of the drum. Each bucket may have a depth of between approximately 75 cm and approximately 150 cm. In certain embodiments, the depth of each bucket may be approximately 1 m. Each of the buckets may have a width of between approximately 100 cm and approximately 200 cm. In certain embodiments, the width of the buckets may be approximately 1 m. Each of the buckets may have an opening angle of between approximately 18 degrees and approximately 30 degrees. In certain embodiments, the opening angle may be approximately 30 degrees. Dimensions may be the same or different for each of the plurality of buckets. The opening angle may start at the end of a radial donut. Radial donuts may spiral along the interior of the drum to provide for movement of the aggregate along the length of the drum.

The drum may also include an external body. The external body may include a plurality of openings to provide for air flow. This air flow may provide for external cooling of the aggregate via the walls of the buckets.

A cooling air supply may provide cooling air to the interior of the drum. The cooling air supply may provide air via jets or nozzles. Cooling air flow rates may be between approximately 750 $m^3$/hr and approximately 20,000 $m^3$/hr.

Cooling Method

Certain methods may provide methods for cooling aggregate. The methods may utilize cooling systems as described herein. In certain embodiments, hot aggregate may be supplied to an end of a drum. The hot aggregate may be supplied at a rate of between approximately 1 ton/hr. and approximately 200 ton/hr. Aggregate may be any suitable material. In certain embodiments, the aggregate particle size may be larger than 5 mm. In certain embodiments, the aggregate patch must be dry.

The drum may be rotated at speeds from approximately 1 rpm to approximately 40 rpm. The drum may be rotated around the axis running the length of the approximate center of the drum. Rotation of the drum may cause movement of the aggregate between the plurality of buckets and along the length of the drum. Residence time in the drum may be approximately 15 minutes to approximately 1 hr.

While the aggregate progresses through the drum, cooling air may be supplied to the interior of the drum. In certain embodiments, the cooling air may be supplied in a direction counter current to the movement of the aggregate through the drum. The radial donuts may move the aggregate along the length of the drum. The rotation of the drum may also move the aggregate from one or more buckets to one or more adjacent buckets, where adjacent buckets—are next to one another in the radial and axial direction. Cooled aggregate may be removed from the drum via the aggregate outlet.

Heat transfer may include thermal contact resistance between cooling system components, random mixing between the hot and cold aggregates, cooling of the rubber belt or of the drum steel body before returning back to be filled with aggregates. The thermal properties of the aggregates bed, rubber belt, aluminum fins, and drum steel body are shown in Table 1. The thermal properties of the aggregates bed are assumed based on 20% porosity.

TABLE 1

| | Density ρ ($kg/m^3$) | Thermal Conductivity K (W/m · ° C.) | Specific heat Cp (J/kg · ° C.) |
|---|---|---|---|
| Air | 1.2 | 0.025 | 1012 |
| Aggregates Bed | 1800 | 0.5 | 835 |
| Rubber | 1522 | 0.16 | 2010 |
| Aluminum | 2700 | 273 | 876 |
| Steel | 7800 | 75 | 460 |

Figure 4:
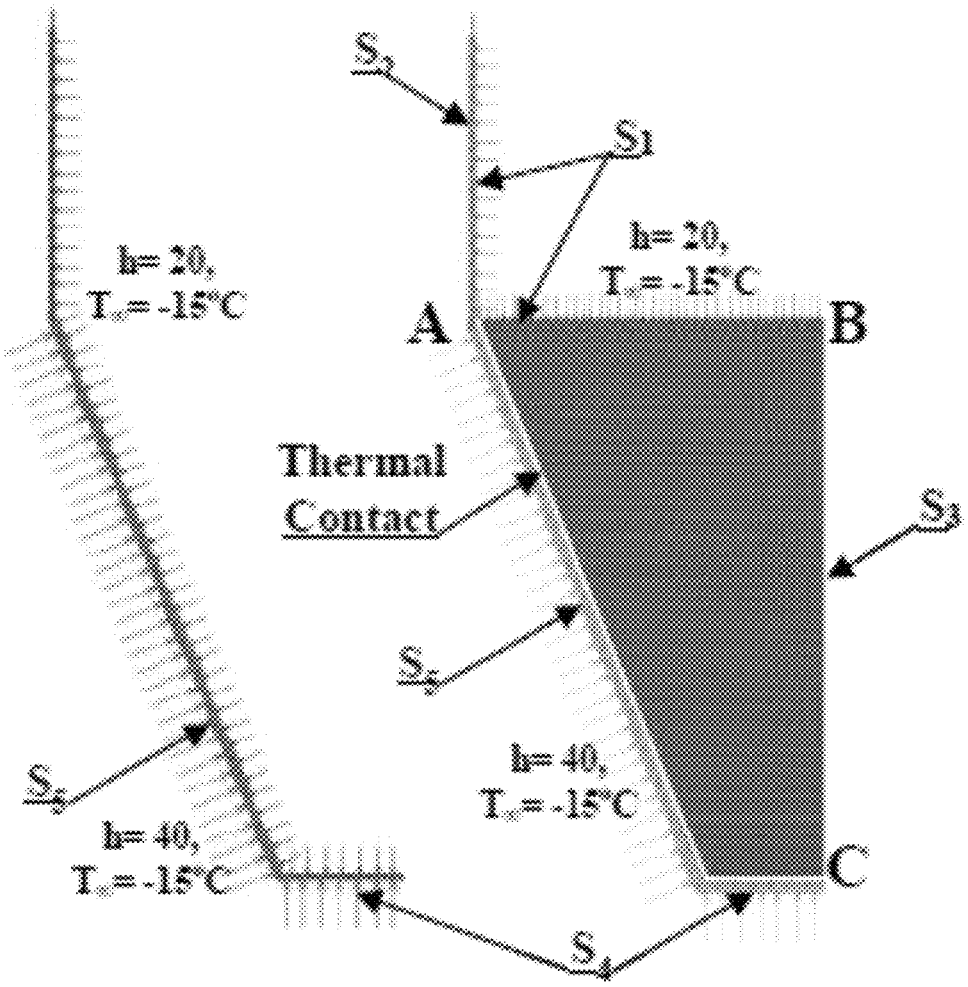
FIG. 4 shows an exemplary cross section of a drum showing a model and boundary conditions of the empty and filled buckets according to an exemplary embodiment.

In certain embodiments, a model may be developed where the drum may be assumed to have four buckets filled with 0.6 m aggregate height all the time. The rest of buckets may be assumed empty. After one third of a drum revolution the four buckets are assumed to fully pour the aggregate into the neighboring four buckets. Three buckets are modeled as shown in FIG. 4. Bucket I is filled with aggregates representing sector I in the drum. The other two buckets II, and III, are empty representing sectors II and III, respectively. The donuts of the drum are assumed to have a pitch of 1 m. This means that for each drum revolution, the aggregates moves forward one meter.

The first law of thermodynamics states that thermal energy is conserved. Specializing this to a differential control volume gives the three-dimensional conduction equation that may be written in the form:

$$\rho c\frac{\partial T}{\partial t} = -\nabla\cdot q + q^B \tag{2}$$

The above equation may be written in the following expanded form for 2-D approximation:

$$\rho c\frac{\partial T}{\partial t} = \left[\frac{\partial}{\partial x}\left(k_x\frac{\partial T}{\partial x}\right) + \frac{\partial}{\partial y}\left(k_y\frac{\partial T}{\partial y}\right)\right] + q^B \tag{3}$$

where kx, ky are the thermal conductivities in the x- and y-directions, respectively (W/m° C.), T is the temperature (° C.), $q^B$ is the internal rate of heat generation per unit volume ($W/m^3$), ρ is the material density ($kg/m^3$), c is the specific heat of the material (J/kg. ° C.), and t is time (sec).

The general boundary conditions that may be applied to Equation (2) may take one of the following forms:

No Heat Flow (Adiabatic or Natural Boundary):

This boundary condition is called the adiabatic or natural boundary condition, and may be expressed as:

$$\frac{\partial T}{\partial n} = 0, \quad \text{on surface } S_i \tag{4}$$

Convection Heat Exchange:

When there is a convective heat transfer on a part on the body surface, Si, due to contact with a fluid medium, it can be written as:

$$-k_n\frac{\partial T}{\partial n} = h(T_s - T_f), \quad \text{on surface } S_i \tag{5}$$

where h is the convection heat transfer coefficient, which may be temperature dependent (nonlinear), $T_s$ is the surface temperature on $S_i$ and $T_f$ is the fluid temperature, which may be constant or a function of boundary coordinate and/or time and $k_n$ is the thermal conductivity in direction n.

Prescribed Temperature (Dirichlet BC):

The temperature may be prescribed on a specific boundary of the body. The prescribed temperature may be constant or a function of boundary coordinate and/or time:

$$T=T_S(x,y,z,t), \text{ on surface } S_i \tag{6}$$

FIG. 4 shows the repeated pattern of the cooling drum. Both models are bounded by symmetry planes $S_2$ and $S_3$. The boundary conditions applied to both simulations, belt conveyor and cooling drum, are defined for the five surfaces $S_1$, $S_2$, $S_3$, $S_4$, and $S_5$ as follows:

$$K\frac{\partial T}{\partial y}\bigg|_{S_1} = h_{S_1}(T_{S_1} - T_\infty) \tag{7}$$

$$K\frac{\partial T}{\partial n}\bigg|_{S_4} = h_{S_4}(T_{S_4} - T_\infty) \tag{8}$$

$$K\frac{\partial T}{\partial x}\bigg|_{S_{2,3}} = 0 \quad \text{Due to Symmetry} \tag{9}$$

$$K\frac{\partial T}{\partial n}\bigg|_{S_5} = h_{S_5}(T_{S_5} - T_\infty) \tag{10}$$

In belt conveyor all surfaces, $S_1$, $S_4$ and $S_5$ are in good cooling conditions, so all heat transfer coefficients at these surfaces are assumed 40 $W/m^{2\circ}$ C. In a cooling drum, internal surfaces of the drum are in worse cooling condition than external surfaces. So, $h_{S1}$ is assumed 20 $W/m^{2\circ}$ C. and $h_{S4}$ is assumed 40 $W/m^{2\circ}$ C. In a cooling drum, two designs are modeled and compared; opened and closed external bodies. In opened external body, the internal and external surfaces of the drum body will be cooled with air jets. Consequently, surface $S_5$ is loaded with convection and $h_{S5}$ is assumed 40 $W/m^{2\circ}$ C. In closed external body, only internal surfaces of the drum body may be cooled with air jets, so surface $S_5$ is assumed adiabatic.

Following the normal finite element discretization and assembly procedures for Equation (2), the model ends up with the global finite element equations in the following form:

$$[C]\cdot\{\dot{\overline{T}}\}+[[K_c]+[K_h]]\cdot\{\overline{T}\}=\{Q\}^s=\{Q\}^h \tag{11}$$

where [C] is the thermal capacity matrix given by $$[C]=\int_T \rho c[N]^T[N]dV; \tag{11a}$$

$[K_c]$ is the thermal conductivity matrix given by $$[K_c]=\int_T[B]^T[K][B]dV; \tag{11b}$$

$[K_c]$ is the additional thermal conductivity matrix due to convection B.C. given by:

$$[K_h]=\int_S h[N^s]^T[N^s]dS; \tag{11c}$$

$[K_h]$ is the additional thermal conductivity matrix due to convection B.C. given by:

$$[K_h]=\int^S h[N^s]^T[N^s]dS; \tag{11d}$$

$\{Q\}^s$ is the heat flux vector due to input surface flux B.C. given by $$\{Q^s\}=\int_S q^s[N^s]^T dS; \tag{11e}$$

and, finally, $\{Q\}^h$ is the heat flux vector due to convection B.C. given by $$\{Q\}^h=\int_S hT_{c_c}[N^s]^T dS; \tag{11f}$$

It should be noted that Equation (11) does not involve radiation boundary conditions and internal heat generation which are not a factor in the current simulation. Time discretization of Equation (11) using the a-method results in the following final equation to be solved for the linear transient simulation:

$$\left[K^c + K^h + \frac{1}{\alpha\Delta t}C\right]\Delta T = {}^{t+\alpha\Delta t}(Q^S + Q^h) - [K^c + K^h]^t T \tag{12}$$

where a is a constant which is between 0 and 1 depending on the solution method used. The following methods are used frequently:

$\alpha=0$ explicit Euler forward method.

$\alpha=½$ implicit trapezoidal rule.

$\alpha=1$ implicit Euler backward method.

The current analysis is solved using the implicit Euler backward method.

Modeling of the Cooling Drum

By referring to FIG. 5, three repeated half buckets are modeled for approximating the cooling drum; buckets I, II, and III. The model assumes four buckets are always filled with aggregates and the rest eight buckets are empty. Bucket I approximates the filled buckets, while bucket II, and III approximate the rest empty buckets. Each one full rotation is divided to three load steps. For load step "i", temperatures of buckets I, II, and III nodes, are obtained from the heat transfer analysis for one third of the time of one full revolution. Then, the initial condition of load step "i+1" are obtained as follows; temperatures of the drum body of the upper bucket (I) are transferred to the middle bucket (II), those of the middle bucket (II) are transferred to the lower bucket (III) and those of the lower bucket (III) are transferred back to the upper bucket (I). The temperatures of the aggregate contents are reapplied and distributed to random locations within the aggregate to simulate the mixing process. For each drum revolution this mechanism is repeated three times namely; "i", "i+1", and "i+2" load steps.

Figure 6:
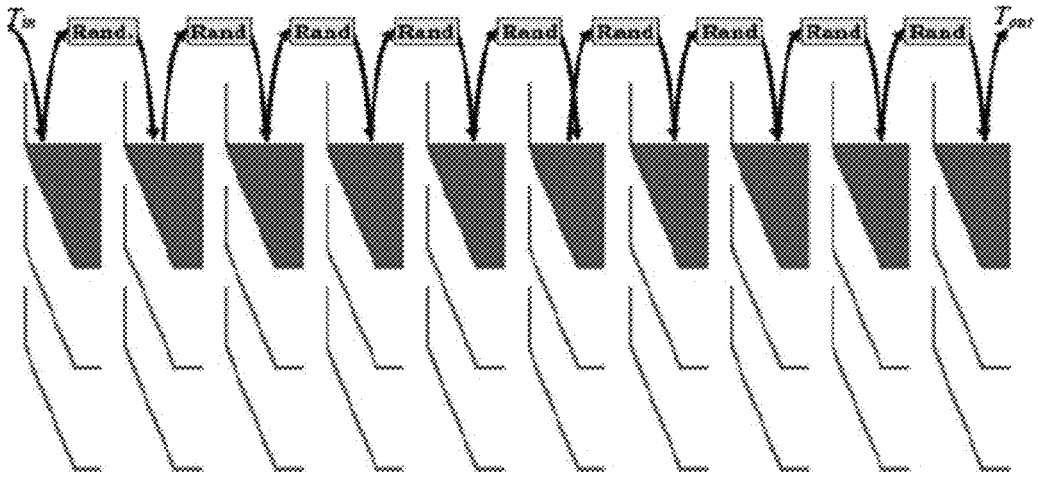
FIG. 6 shows a schematic of initial conditions calculation mechanisms for drum compartments after one complete revolution of the drum according to an exemplary embodiment.

Along the length of the drum, a total of ten compartments are modeled similar to the above model, FIG. 6. After one full revolution, the calculated temperatures of the aggregate of each compartment are moved forward to the next compartment with random allocations and the temperature of the aggregate in the first compartment is initialized again to 50° C. simulating a new aggregate fed to the drum. Finally the resulted temperatures of the aggregate of the last compartment are averaged to report the final output temperature $T_{out}$, FIG. 6.

Cooling Drum

Figure 7:
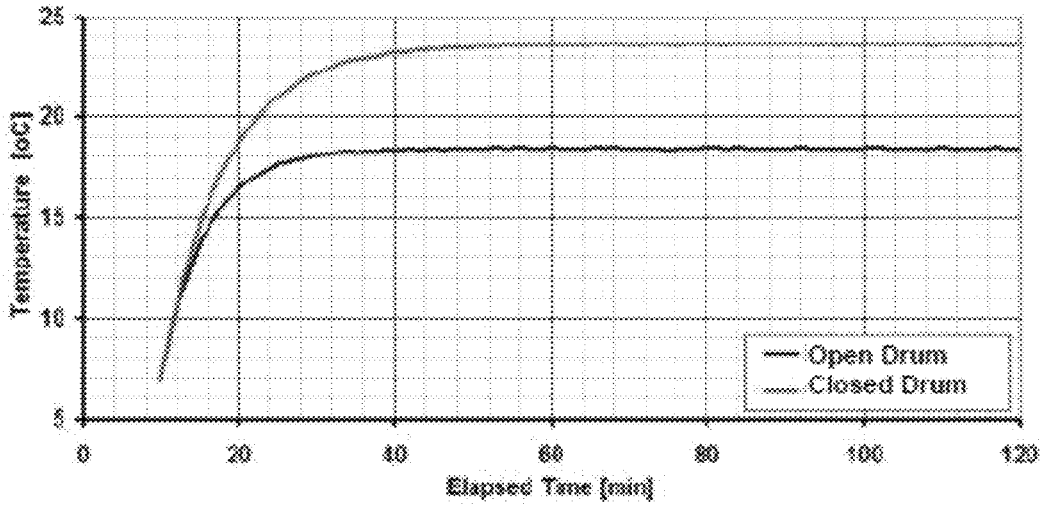
FIG. 7 shows a graph of average steady state temperature of the aggregates at the drum exit according to an exemplary embodiment.
Figure 8:
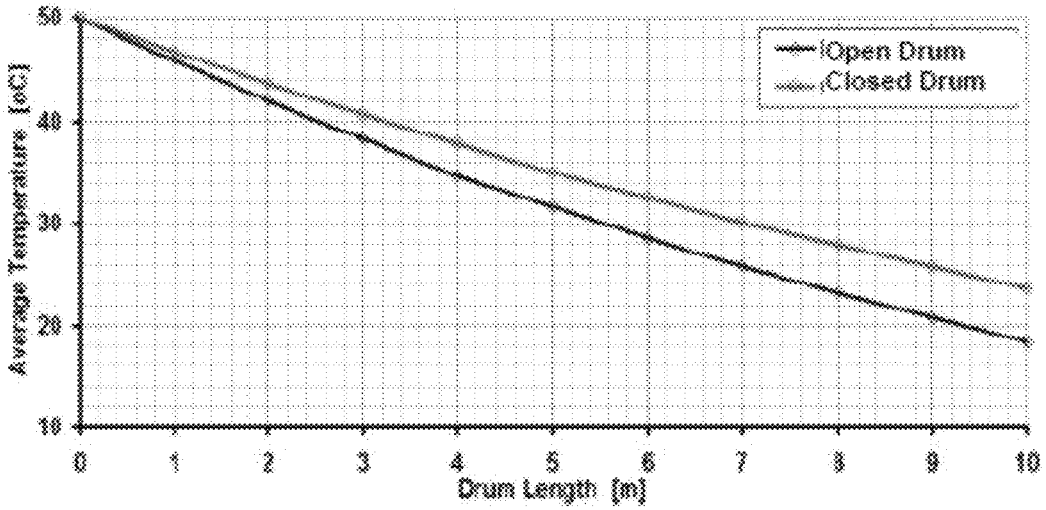
FIG. 8 shows a graph of aggregate steady state temperatures through drum buckets according to an exemplary embodiment.
Figure 9:
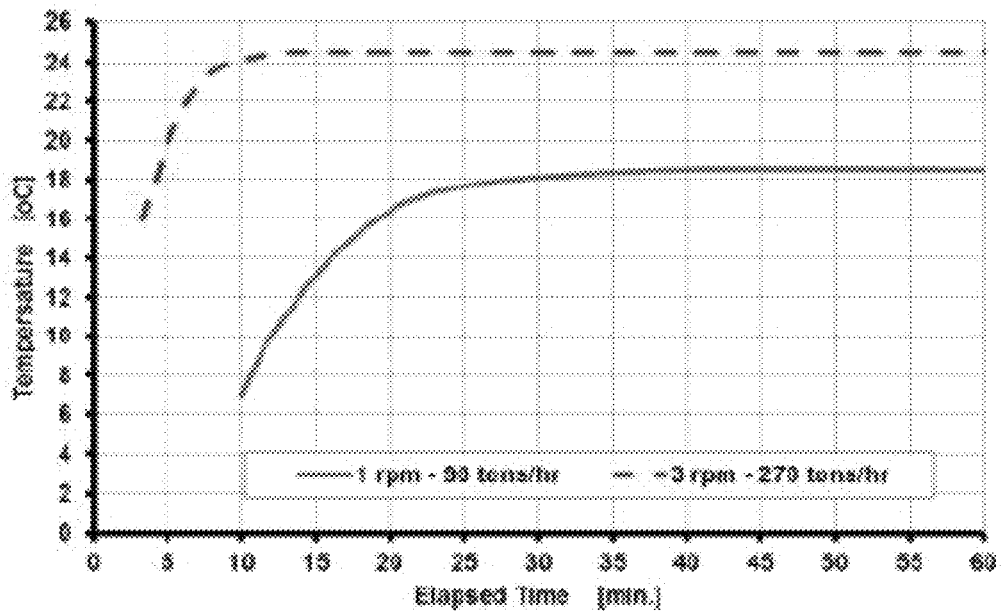
FIG. 9 shows a graph of aggregate average temperature at the exit of the cooling drum at different cooling rates according to an exemplary embodiment.
Figure 10:
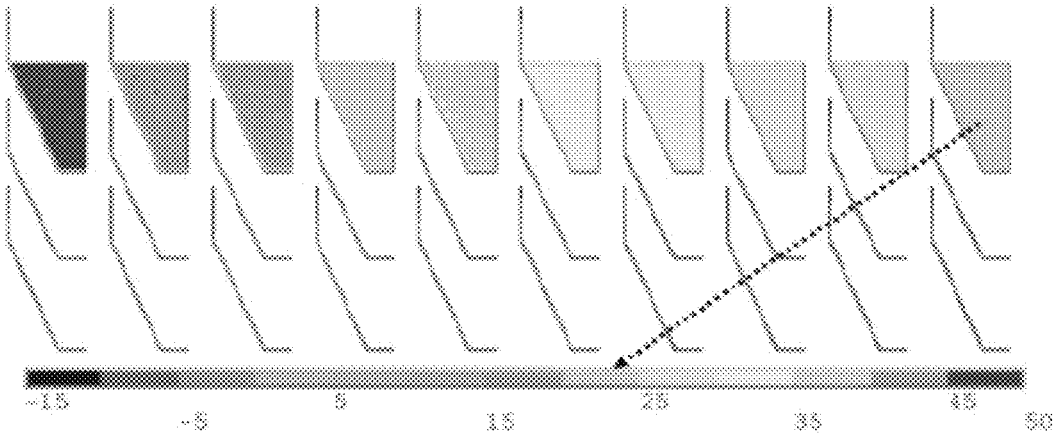
FIG. 10 shows a schematic of aggregate steady state temperature distributions in Celsius through drum buckets in the closed drum body design according to an exemplary embodiment.
Figure 11:
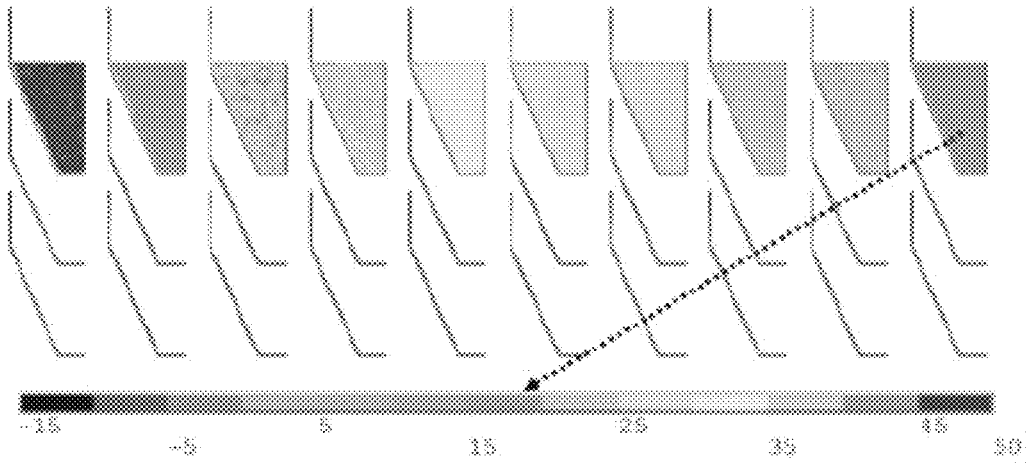
FIG. 11 shows a schematic of aggregate steady state temperature distributions in Celsius through drum buckets in the open drum body design according to an exemplary embodiment.

FIG. 7 shows the aggregate temperatures at the exit of the cooling drum for both configurations. In this exemplary embodiment, the first patch leaves the drum after 10 minutes, for 1 rpm drum rotational speed. There is no difference between the opened and closed drum designs at the early time of the simulation. This may be attributed to the fact that the drum body temperature is initially set at −15° C. and that temperature is increased and reach a steady state value after enough time of contact with the hot aggregate. It is noted that by the time the drum body gains heat reaching steady state, the difference in results is quite significant and reaches up to 5° C. This difference also increases along the length of the drum. The average temperature of the aggregates at each bucket within the drum length is shown in FIG. 8. If the aggregate stays more time in the drum, these differences will be more significant. Most manufacturers would place a maximum time stay limit of approximately 30 minutes in the drum. The gained temperature due to the drum body is also more significant as the aggregate moves towards the exit of the drum. Drum rotation of 1 rpm reduce the temperature of 90 tons per hour. For higher rate production, the final temperature will be bit higher. FIG. 9 shows the drum cooling performance at rotation of 3 rpm which serves production rate of 270 tons of aggregates per hour. The temperature distributions of the aggregate within the drum buckets for the opened and closed drum designs are compared in FIGS. 10 and 11.

Cooling concrete aggregates is a crucial factor in hot weather regions to retain the concrete strength. Existing cooling methods in the literature are not optimized for power and cooling time minimization. Most of the existing designs perform some mixing of the aggregates in a cold environment. These designs do not utilize the full advantages of proper mixing, free falling of aggregates, extended belt surface area for heat convection with belt conveyors, and extended metal surface area for heat convection with cooling drums.

Certain embodiments utilize cooling system configurations as described herein for hot weather concreting. In certain embodiments these configurations may include a belt conveyor for small production rates, such as, but not limited to, approximately 3-15 tons/hr, and rotating drums for high production rates, such as, but not limited to, approximately 90-270 tons/hr. Modeling has shown the significant impact of the mixing process on the cooling efficiency. The simulation results showed the importance of enhancing the cooling conditions of the drum body by cooling the drum body as well as cooling the hot aggregate to get lower aggregate output temperature with reduced power.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

What is claimed is:

1. A system for cooling aggregate, the system comprising:

a drum comprising:

an aggregate inlet;

a plurality of buckets, in which holes are designed, arranged in a ring around a circumference of the drum, and a plurality of rings arranged along a length of the drum, wherein each of the plurality of buckets has openings that open into an interior of the drum;

one or more radial donuts or radial webs within the interior of the drum;

an aggregate outlet;

a cooling air supply; and an external body that entirely encapsulates the plurality of buckets, wherein one or more buckets define respective second openings that expose an aggregation disposed in the one or more buckets, wherein the external body comprises a plurality of openings that are in direct communication with external atmospheric conditions, and wherein the second openings are in direct communication with the plurality of openings of the external body to provide direct external cooling of the aggregation through external walls of the buckets.

2. The system of claim 1, wherein the plurality of buckets is twelve buckets.

3. The system of claim 1, wherein the buckets have a depth of approximately 1 m.

4. The system of claim 1, wherein the buckets have an opening angle of approximately 45 degrees, and start at an end of a radial donut.

5. The system of claim 1, wherein the predetermined width is approximately 0.6 m.

6. The system of claim 1, wherein the cooling air supply is counter current to the direction of travel of the aggregate through the drum.

7. The system of claim 1, wherein the drum is rotated to move the aggregate along a length of the bucket which contains holes, between the plurality of buckets and along the length of the drum.

8. A method for cooling aggregate, the method comprising:

supplying hot aggregate to an end of a drum, wherein the drum comprises an aggregate inlet; a plurality of buckets in which holes are designed, arranged in rings around a circumference of the drum, and a plurality of rings arranged along a length of the drum, wherein the plurality of buckets has openings that open into an interior of the drum; one or more radial donuts or radial webs within the interior of the drum; and an aggregate outlet;

rotating the drum to cause movement of the aggregate along a length of the bucket which contains holes, between the plurality of buckets and along the length of the drum; and supplying cooling air to the interior of the drum, wherein the drum further comprises an external body that entire encapsulates the plurality of buckets, wherein one or more buckets define respective second openings that expose an aggregation disposed in the one or more buckets, wherein the external body comprises a plurality of openings that are in direct communication with external atmospheric conditions, and wherein the second openings are in direct communication with the plurality of openings of the external body to provide direct external cooling of the aggregation through external walls of the buckets.

9. The method of claim 8, wherein the radial donuts move the aggregate along the length of the drum.

10. The method of claim 8, wherein the cooling air is supplied in a counter current to the movement of the aggregate along the length of the drum.

11. The method of claim 8, further comprising removing cooled aggregate from the aggregate outlet.

12. The method of claim 8, wherein the plurality of buckets is twelve buckets.

13. The method of claim 8, wherein the buckets have a depth of approximately 1 m.

14. The method of claim 8, wherein the buckets have an opening angle of approximately 45 degrees, and start at an end of a radial donut.

15. The method of claim 8, wherein the predetermined width is approximately 0.6 m.

* * * * *